United States Patent [19]

Freeman et al.

[11] Patent Number: 4,786,046

[45] Date of Patent: Nov. 22, 1988

[54] HANDLING OF SHEET MATERIALS

[75] Inventors: Michael A. Freeman, Clacton-on-Sea; Brian Nicholson, St. Osyth, both of England

[73] Assignee: John Waddington PLC, England

[21] Appl. No.: 25,440

[22] Filed: Mar. 13, 1987

[30] Foreign Application Priority Data

Mar. 15, 1986 [GB] United Kingdom ..... 8606436
Mar. 18, 1986 [GB] United Kingdom ..... 8606629

[51] Int. Cl.[4] ..... B65H 29/54

[52] U.S. Cl. ..... 271/276; 271/307; 271/309; 271/195; 271/900

[58] Field of Search ..... 271/307-309, 271/311, 312, 196, 195, 94, 96, 97, 900, 5, 11, 90, 98, 108, 275, 276, 314; 156/DIG. 28, DIG. 38

[56] References Cited

U.S. PATENT DOCUMENTS

| | | | |
|---|---|---|---|
| 1,595,478 | 8/1926 | Minton | 271/97 X |
| 3,804,401 | 4/1974 | Stange | 271/309 X |
| 4,089,725 | 5/1978 | Crankshaw et al. | 271/97 X |
| 4,526,648 | 7/1985 | Tochtermann | 271/195 X |
| 4,566,933 | 1/1986 | Crankshaw et al. | 156/DIG. 38 X |

FOREIGN PATENT DOCUMENTS

| | | | |
|---|---|---|---|
| 2109237 | 9/1972 | Fed. Rep. of Germany | 271/196 |
| 2164528 | 7/1973 | Fed. Rep. of Germany | 271/309 |

*Primary Examiner*—Joseph J. Rolla
*Assistant Examiner*—David H. Bollinger
*Attorney, Agent, or Firm*—Klauber & Jackson

[57] ABSTRACT

The invention provides that a vacuum drum with rows of vacuum ports over its surface is used to transport self adhesive labels from a first location at which the labels are applied (adhesive surface outwards) to the drum to a second location at which the labels are detached from the drum. The labels are held to the drum during the transport by applying vacuum to the ports until the label reaches the second location, when the first and second rows of ports at the leading edge of the label are applied with air under pressure, the pressure of the air supplied to the second row of ports being less than that supplied to the first row and slightly in advance in the time sequence, so that the edge of the label is slightly inwardly of the adjacent label extremity, initially lifted from the drum and then the extremity is blown sharply away from the drum providing effective, positive and reliable detachment of the labels from the drum.

6 Claims, 1 Drawing Sheet

HANDLING OF SHEET MATERIALS

This invention relates to the handling of sheet materials, and more particularly concerns the handling of individual sheet articles such as labels, tickets, coupons or the like by appropriate machinery in order to transport and transfer the sheet materials from one surface or location to another.

In, for example, the application of individual labels to bottles or articles in a mechanized process, there arises frequently the need to handle and transfer the labels from one location to another. Specifically, in an area in which we are interested, individual labels are cut from a web of material leaving a skeletal waste, and the labels are held by means of a drum or plate which moves so as to move the cut labels in a path which is different from the path of travel of the skeletal waste. Subsequently, the labels are removed from this carrier and are either applied directly to articles or are transferred by an intermediate carrier to a location where they are applied to said articles. In this connection, one face of the labels may be provided with an adhesive which is either pre-applied or subsequently applied. The form of adhesive is not of particularly material consideration in relation to the present invention, but it may be for example pressure sensitive adhesive or heat activated adhesive or indeed water activated adhesive and will be to the outer surface of the label in relation to the carrier which transports the label.

In our European Patent Application No. 823065057 we have set forth one method of detaching labels from a rotary vacuum drum. The labels are held to the drum surface through suitable ports to which a vacuum is applied, but when the label reaches a position whereat detachment is required, air under pressure is applied through some of these ports in an attempt to blow the label from the drum surface and directly onto an article moving in synchronism with the drum. It has been found in experimenting with and developing such a system that because of the port design size of aperture, in fact there is no blowing away of the label from the drum, but rather what appears to happen is that a film or layer of air exists under the label in the region of the ports through which the pressure air is blown, and the label simply lifts from the drum surface, to a very small extent i.e. of the order of 1 mm. and is not physically blown away from the drum surface, which indeed is what is required.

Specifically, keeping in mind that the drum may be handling labels at the rate of 200 per minute, such labels may not be blown from and do not leave the drum, And consequently, there is fouling and severe blockage of the apparatus.

The present invention was made in an effort to overcome this difficulty, and whilst its immediate use will be in relation to the apparatus in which we are interested i.e. the handling of labels by rotary vacuum drums, it will be appreciated that it is not necessary that the invention should be so limited to such specific application.

Various experiments and trials were conducted before the present invention was finally reached. In particular, in a first experiment, the ports through which the air blast was conducted were surrounded by annular ports through which low pressure air was conducted in an effort more positively to detach the labels, but this experiment produced no improved effect. Secondly, instead of utilizing apertures to form the ports, the said ports were defined by sintered metal plugs in an effort to provide greater air distribution, but again this experiment was unsuccessful. Thirdly, a channel was formed around the exit ports in an effort to provide a body of pressure air in free space, but again this development proved unsuccessful.

The present invention however has shown itself to be extremely useful for the purpose, and in accordance with the present invention the method comprises detaching a sheet element from a support surface having a plurality of apertures therein through which pressure air can be supplied in order to detach at least one edge of the sheet, the method residing in that pressure air is supplied to porting in a region which is inwardly spaced of the edge of the sheet material to be detached, followed by injection of higher pressure air through porting which the edge to be detached overlies.

This arrangement has been shown to work extremely well insofar as when the lower pressure air is applied to the sheet inwardly of the edge thereof, the sheet lifts from the surface at that point, and when the subsequent blast of air is applied to the porting covered by the edge, then that edge is positively and clearly blown away from the surface. Once the edge of the sheet material is thus separated from the surface, it then becomes a relatively easy matter to control the positive displacement of the entire sheet from the surface. For example, a paring knife edge can engage under the detached sheet edge preventing it from returning to the said surface.

In specific application, the said surface supporting the sheet will be movable, and preferably will be a rotary drum to which individual sheets are applied in turn and are removed in turn, and in one example the said drum comprises a vacuum drum provided with a plurality of rows of vacuum ports to which vacuum can be applied in order to hold the sheets thereto whilst the sheets travel between an application location and the detachment location, but which at the detachment location can become the ports which are pressures in accordance with the method of the present invention.

In a specific example, if one considers that the drum is handling labels and the labels for simplicity's sake are rectangular with the longer sides extending axially of the drum, each label in relation to the direction of rotation of the drum will have a leading edge and a trailing edge. In the specific application of the method of the invention, the leading edge will be the edge which is detached in accordance with the invention, and the first row of ports which is under the leading edge of the label will at the appropriate time have the injection of air under pressure, but the second row will be provided with air under pressure first, and at a different (lower or higher) pressure. Suitable coupling porting must be provided on the mountings for the drum to ensure that this happens, because in the operation of this particular apparatus, normally the ports will be connected to a source of vacuum in order that the labels will be held to the drum as they travel between the application location and the detachment location, but when the first and second rows of ports reach the application location, air under pressure is to be supplied thereto as described above. Equally, the third and subsequent rows of ports covered by the label are coupled to the source of pressure as the said rows pass the application location.

The invention also provides apparatus constructed to operate in accordance with the method.

The method has shown itself to be extremely useful in high speed label application situations, especially when a rotary drum is used for the transport of the labels between attachment and detachment locations spaced relative to the drum periphery.

The method may be used in conjunction with suitable knife means to assist the detachment of the labels from the surface, and such knife means may comprise a mechanical knife member, or for example an air knife arrangement.

It will be appreciated that the invention can be applied for the handling of other sheet elements apart from labels, and also that the labels to be handled can be of any size and configuration. The labels may be the so-called patch labels or wrap round labels the latter being of a type to be wrapped completely round the articles to which they are to be applied.

The method of the invention can be utilized for the handling of sheet materials which are delicate and flimsy as the vacuum and positive pressures can be controlled as desired. Also, as air will be the most likely gas to be used for the creation of the vacuum and air pressure, it is to be appreciated that any gaseous medium can be used.

An embodiment of the invention will now be described, by way of example, with reference to the accompanying diagrammatic drawings, wherein.

Figure 1:
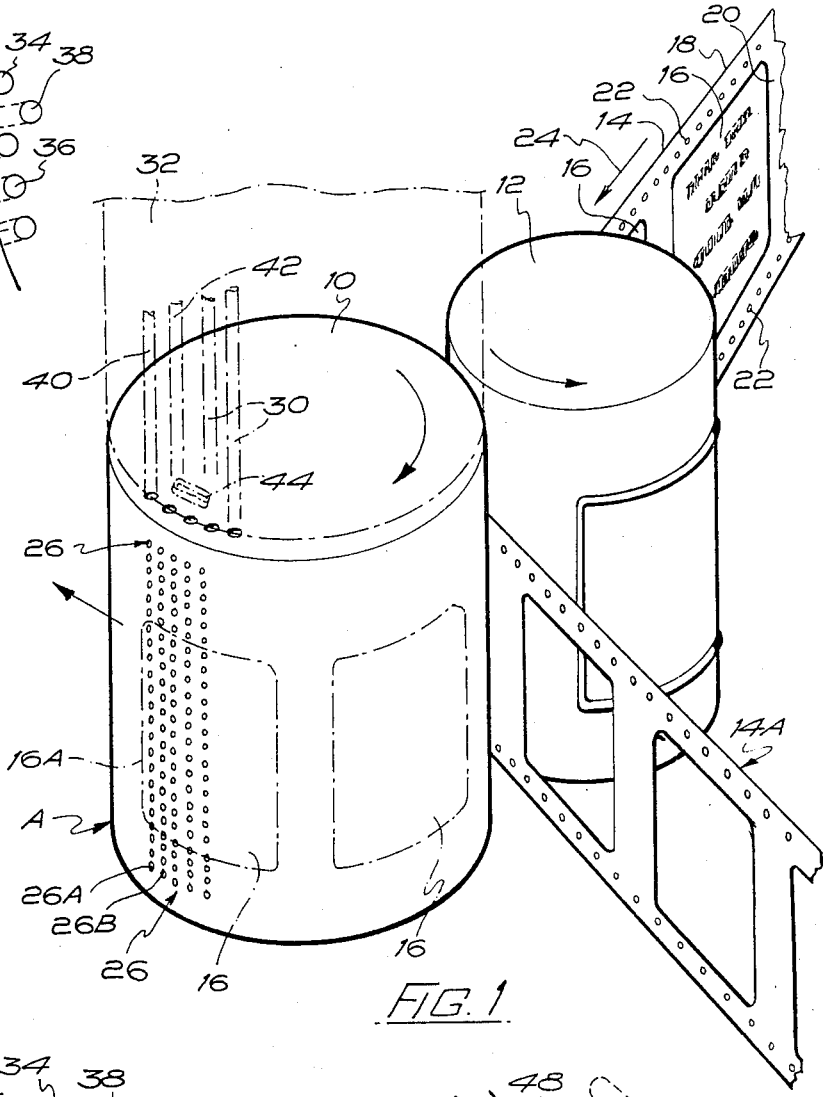
FIG. 1 is a perspective view of an arrangement according to the present invention.

Referring to the drawings, in FIG. 1 there is shown a vacuum drum 10 which co-operates with a die cutting drum 12, these drums being rotatable as indicated by the arrows, and defining there-between a cutting lip through which a web 14 having labels 16 defined thereon passes.

The web 16, is as disclosed in our European Patent Application No. 823065057 and has pressure sensitive adhesive on side 18, and a release coat on side 20 so that the release coat in fact covers the label printing 16 and enables the web 14 to be wound into roll form without the use of a backing web. Additionally, although it forms no part of the present invention, the web 14 has sprocket drive apertures 22 along the edges thereof.

As the web passes through the nip between drums 10 and 12, with the web moving in the direction of arrow 24, the individual labels 16 are cut from the web 14 so as to leave a skeletal waste 14A which is taken away from the nip for disposal, the labels 16 being held to the drum 10 by the application of a vacuum to ports 26 in the cylindrical surface thereof to which the labels 16 are held. When the labels 16 are so held to drum 10, the adhesive surfaces are outermost enabling the labels to be applied directly to articles which move into close proximity with the surface of the drum 10 at an application location (region A in FIG. 1) so that the labels 16 can be transferred from the drum to the articles. The entire process is a continuous process in that the web 14 is fed continuously and the drums 10 and 12 are adhered continuously, thereby achieving high speeds although a step by step arrangement can also be utilized.

The running of such machinery at high speeds as can be appreciated brings problems of efficiently separating the labels 16 from the vacuum drum 10 and the present invention provides a method for achieving the reliable separation of the labels from the vacuum drum. This is achieved in the following manner. It will be noticed that the ports 26 are arranged in rows 26A, 26B and so on, extending axially of the periphery of the drum 10 and arranged in parallel with each other and the vacuum is applied to these ports through vacuum lines 30 in a vacuum valve block 32 which remains stationary as drum 10 rotates. The vacuum is applied to the ports 26 between the location of the nip and the separation location A so that the labels 16 will be held to the drum 10 as shown, but when the leading edge 16A of each label 16 reaches the location A, the leading ports such as 26A and 26B are supplied, instead of with vacuum, with air under pressure in order to blow the leading edge 16A away from the surface of the drum 10, and as the further rows of ports 26C pass the release station A, so such rows of ports progressively are supplied with air under pressure in order that there will be a continuous blowing of the label 16A away from the drum surface throughout the arcuate extent to which the label 16 overlaps the drum 10.

Figure 2:
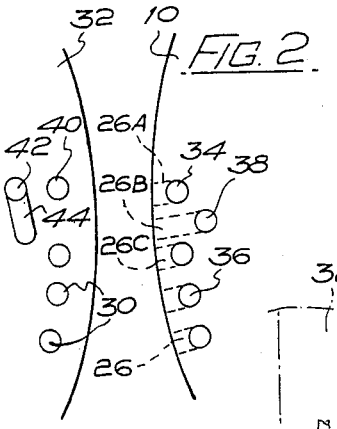
FIG. 2 is a development view showing the vacuum drum, and the valve drum in opened out condition.
Figure 3:
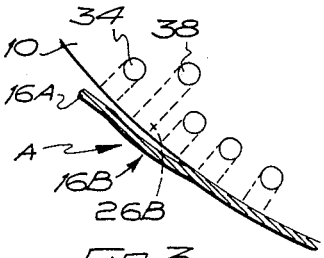
FIGS. 3 and 4 show how a label is separated from the vacuum drum in accordance with the method of the invention.
Figure 4:
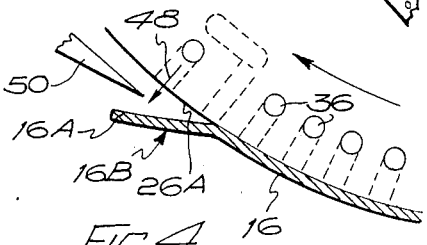

In accordance with the present invention however, the sequence of blowing is controlled so as to give positive displacement of the leading edge 16A of the label away from the drum surface, and this can best be explained by referring to FIGS. 2, 3 and 4.

In FIG. 2 it is seen that the ports 26A are supplied from an inlet 34 lying relatively close to the periphery of drum 10, and ports 26C to 26N are supplied by inlets 36 which are on the same patch circle as port 34. However, ports 26B i.e. the second row of ports are supplied from an inlet 38 which is located on a smaller pitch circle than the ports 34 and this is to provide that air under pressure will be supplied to the ports 26B in fact fractionally before it is supplied to the ports 26A when the leading edge 16A of the label 16 is to be removed from the drum. The method of achieving this can also be understood from FIG. 2 in which the underside of the valve block 32 is shown, and it will be seen that there is a first air pressure port 40 and a second air pressure port 42 these also being shown in FIG. 1, port 40 lying on a pitch circle of the block 32 which registers with the pitch circle containing the inlets 34 and 36 in the drum 10, whilst port 42 lies on a pitch circle which registers with the pitch circle containing inlet 38 in drum 10. On the undersurface of the valve block 32 there is a gallery 44 leading from port 42 and extending circumferentially of block 32. This gallery 44 is arranged to register with the inlet 38 before port 40 registers with inlet 34 when the valve block 32 and drum 10 are operationally arranged as shown in FIG. 2.

As a result, when the machine operates, the pressure air supplied through inlet port 42 in the valve block will be supplied to the inlet 38 and ports 26B before air under pressure is supplied through port 40 to inlet 34 and eventually to ports 26A. Furthermore, the pressure of air supplied to the ports 26B is from a regulated source and will be lower than that supplied to the ports 26A.

FIGS. 3 and 4 show what happens as the gallery 44 registers with inlet 30A and when port 40 registers with inlet 34.

In FIG. 3, which shows in cross section, leading edge 16A of the label lying on the drum 10 at the detachment location A, and the gallery 44 has registered with port 38 and has supplied air under pressure through ports 26B. The leading edge 16B of the label 16 has lifted from the surface of the drum 10 but only to a very small extent, for example of the order of 1 mm, and would remain in this condition were it not for the subsequent application of higher pressure air blast through the inlet 34, and this is achieved when the port 40 registers with inlet 34 to provide the condition shown in FIG. 4. The high pressure air blast indicated by arrow 48 in FIG. 4 in issuing through ports 26A causes the leading edge portion 16B in fact to hinge sharply away from the surface of the drum 10 as shown in FIG. 4, enabling for example the insertion of a mechanical paring knife 50 into a location between the label leading edge 16A and the surface of the drum 10. Continued rotation of the drum 10 means that the subsequent inlets 36 are applied in turn with air under pressure progressively to detach the label 16 from the drum surface.

The system as described works excellently under test conditions, and will provide a means whereby the labels can be detached positively and effectively and at high speed so that they can be applied reliably to the articles which move in synchronism therewith.

What is claimed is:

1. A method of detaching a sheet element from a support surface wherein the support surface has a plurality of apertures through which air under pressure can be applied, comprising the steps of:

supplying low pressure air to some of said plurality of apertures in a region which is inwardly spaced from an edge of the sheet element to be detached, and injecting air at a pressure higher than said low pressure air through other of said plurality of apertures over which the edge of the sheet element to be detached overlies, following said step of supplying low pressure air, so as to detach said edge from a detachment location of the support surface.

2. A method according to claim 1, further comprising the step of detaching a remainder of the sheet element from the support surface by a paring knife engaging under the edge of said sheet element which has been detached by said low and high pressure air.

3. A method according to claim 1 or 2, wherein said support surface is the surface of a rotating drum, and further comprising the steps of:

moving the surface of the rotating drum, applying individual ones of said sheet elements in turn to said drum, said drum being a vacuum drum provided with a plurality of rows of said apertures, applying a vacuum to said apertures in order to hold the sheet elements thereto while the sheet elements travel between a location where the sheet elements are applied to the vacuum drum and the detachment location, and subsequently supplying the apertures with said low pressure and higher pressure air to detach the sheet elements from the vacuum drum.

4. A method according to claim 3, wherein the sheet elements are rectangular, self adhesive labels, and further comprising the step of applying said labels to the drum with longer sides thereof extending axially of the drum and holding said sheet elements to the drum with an adhesive side thereof facing away from the drum surface.

5. A method according to claim 4, wherein said edge is a leading edge of each label, a first row of said apertures being located under the leading edge of each label and a second row of apertures being located under an inwardly located part of the leading edge of each label; and further comprising the step of applying said low and higher air pressures to said second and first rows of said apertures, respectively, when each label reaches the detachment location so as to detach the leading edge of each label from the drum surface.

6. A method according to claim 5, further comprising the step of applying a vacuum to said first and second rows of said apertures to hold the labels to the drum until the apertures reach the detachment location.

* * * * *